United States Patent [19]

Brooks et al.

[11] Patent Number: 4,643,483

[45] Date of Patent: Feb. 17, 1987

[54] FLUID SUPPLY SYSTEM TO ROTARY CUTTER HEADS ON MINING MACHINES

[75] Inventors: Derek J. Brooks; Granville C. James, both of Ashby-de-la-Zouch, England

[73] Assignee: Coal Industry (Patents) Limited, United Kingdom

[21] Appl. No.: 680,472

[22] Filed: Dec. 11, 1984

[30] Foreign Application Priority Data

Jan. 20, 1984 [GB] United Kingdom ..... 8401507

[51] Int. Cl.[4] ..... E21C 25/10

[52] U.S. Cl. ..... 299/81; 299/85; 299/87

[58] Field of Search ..... 299/12, 81, 85, 87

[56] References Cited

U.S. PATENT DOCUMENTS

| | | | |
|---|---|---|---|
| 4,465,318 | 8/1984 | Lewis et al. | 299/81 X |
| 4,501,449 | 2/1985 | Eagles | 299/81 |
| 4,521,058 | 6/1985 | Eagles et al. | 299/81 |
| 4,533,180 | 8/1985 | French et al. | 299/81 X |

FOREIGN PATENT DOCUMENTS

| | | |
|---|---|---|
| 1110763 | 10/1963 | United Kingdom . |
| 1111319 | 4/1968 | United Kingdom . |
| 1336791 | 11/1973 | United Kingdom . |
| 1207817 | 11/1973 | United Kingdom . |
| 1452862 | 10/1976 | United Kingdom . |
| 2015625 | 9/1979 | United Kingdom . |
| 2019920 | 11/1979 | United Kingdom . |
| 2106962 | 4/1983 | United Kingdom . |

*Primary Examiner*—Stephen J. Novosad
*Assistant Examiner*—Thomas J. Odar
*Attorney, Agent, or Firm*—Stevens, Davis, Miller & Mosher

[57] ABSTRACT

A fluid supply system provides a non-rotary component comprising an inlet adaptor unit, passage means extending along the rotary drive shaft and distributor means mounted within the rotary cutter head. The non-rotary distributor means provide outlet nozzles arranged to direct air flow inducing sprays towards air ducts provided on the rotary hub assembly.

6 Claims, 2 Drawing Figures

FLUID SUPPLY SYSTEM TO ROTARY CUTTER HEADS ON MINING MACHINES

Figure 1:
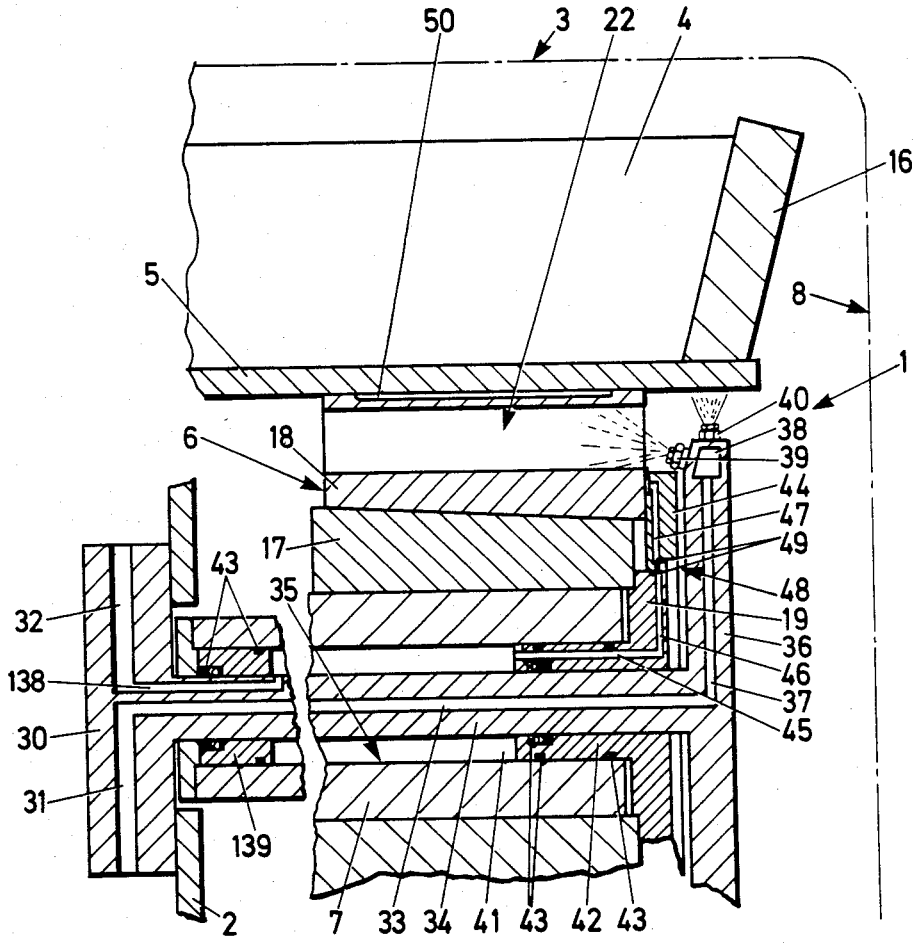

This invention relates to fluid supply systems for rotary cutter heads for mining machines.

In particular, although not exclusively, the present invention relates to water feed systems to nozzles mounted on and or adjacent to the rotary cutter head.

It is known for separate fluid feed arrangements to supply relatively low pressure water to a first set of nozzles mounted adjacent to the outer periphery of the rotary cutter head in order to direct sprays into the cutting zone and relatively high pressure water to a further set of nozzles mounted adjacent to the hub assembly of the cutter head to direct air flow inducing sprays axially of the cutter head. The sprays from the nozzles adjacent to the outer periphery of the cutter head tend to reduce or control dust generated during cutting and the air flow inducing sprays tend to ventilate the cutter head tending to prevent or reduce the build up of methane gas construction as well as tending to remove or control the respirable dust extracted from the cutting zone. In such known fluid supply systems the separate fluid feed arrangements are contacted along a drive shaft upon which the cutter drum is mounted to a common distributor secured to, and arranged to rotate with, the cutter head.

Unfortunately, with such known fluid feed arrangement the inlets for the ventilating induced air flow tend to become blocked or partially blocked with cut mineral which tends to be drawn into the inlets by the induced air flow. Such blockage tends to greatly reduce the efficiency of the ventilating system and if not cleared could give rise to a potentially dangerous condition.

Another problem associated with the known fluid supply arrangement is that a rotary seal is required in the relationship high pressure feed between the non rotary inlet feed and the rotating distributor. Such seals tend to be liable to damage when mounted within a rotary cutter head and troublesome to replace. Moreover, failure of a seal tends to require a time consuming replacement operation during which production is halted.

An object of the present invention is to provide an improved fluid feed system for a rotary cutter head of a mining machine which tends to overcome or reduce the above mentioned problems.

According to the present invention, a fluid supply system for a rotary cutter head for a mining machine having a non rotary body and a rotary drive shaft upon which the cutter head is mountable, the supply system comprising an adaptor unit mountable on the machine body and defining fluid inlet means, passage means for feeding fluid from the inlet means along the drive shaft, and distributor means for feeding fluid from the passage means to outlet nozzle means, the adaptor unit, passage means and distributor means constituting a non rotary component.

Preferably, the outlet nozzle means are adapted to direct air flow inducing sprays within the rotary cutter head.

Advantageously, the adapter unit defines further fluid inlet means for a second fluid feed which, in use, is fed via further passage means to further distributor means for feeding fluid to further outlet nozzle means mountable on the cutter head.

Preferably, the further distributor means is adapted to rotate with the cutter head.

The present invention also provides a rotary cutter head for mounting on a rotary drive shaft of a mining machine, the cutter head having a hub assembly drivably mountable on the drive shaft, a support component mounted around the hub assembly, a plurality of cutting tool holders supported by the support component, and a fluid supply system comprising an adaptor unit mountable on the mining machine and defining fluid inlet means, passage means for feeding fluid from the inlet means along the drive shaft, and distributor means for feeding fluid from the passage means to outlet nozzle means, the adaptor unit, passage means and distributor means constituting a non rotary component.

Preferably, an air flow duct arrangement is provided around the hub assembly, the outlet nozzle means being adapted to direct air flow inducing sprays associated with the air flow duct arrangement.

Advantageously, the adaptor unit defines further fluid inlet means for a second fluid feed which, in use, is fed via further passage means to further distributor means for feeding fluid to further outlet nozzle means mountable on the cutter head.

Preferably, the further distributor means is adapted to rotate with the hub assembly.

Figure 2:
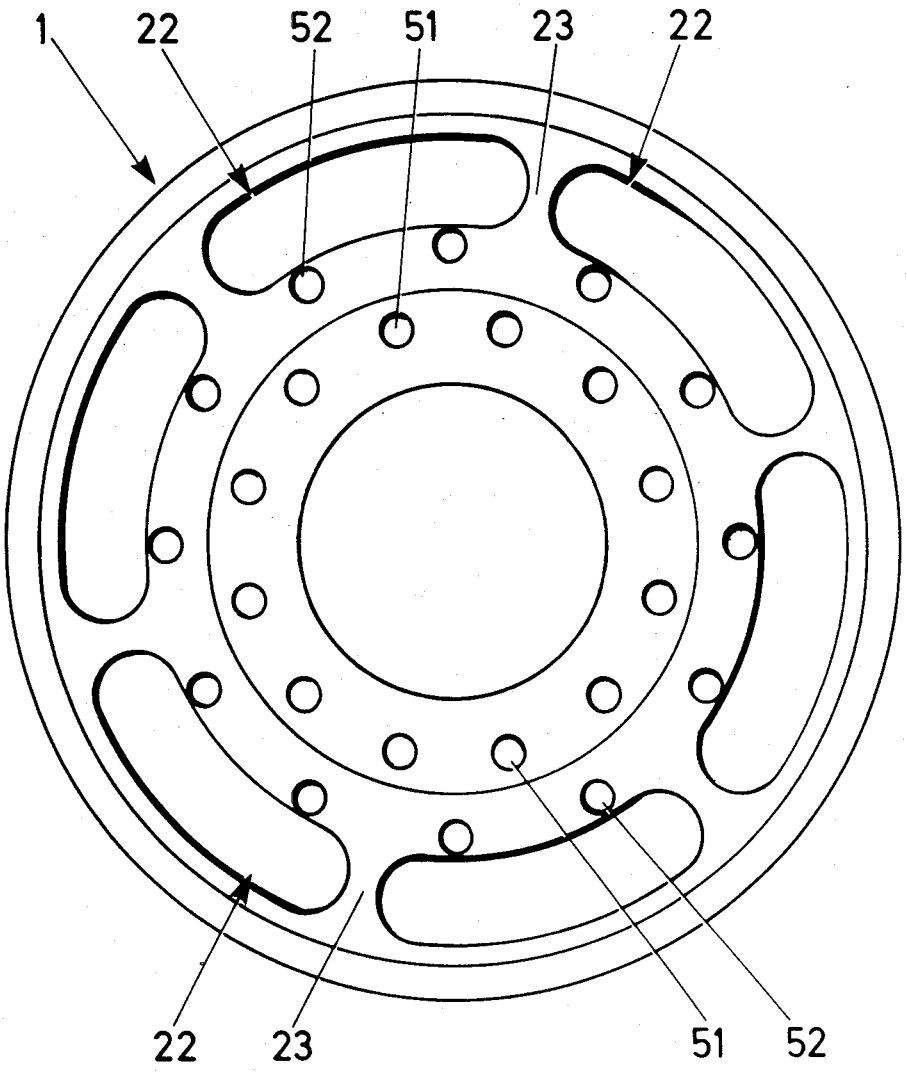

By way of example only, one embodiment of the present invention will be described with reference to the accompanying drawings, in which:

FIG. 1 is an incomplete diagrammatic cross-sectional view taken along the rotational axis of a rotary cutter head of a mining machine, the cutter head being provided with a fluid supply system constructed in accordance with the present invention, and FIG. 2 is an incomplete end view of the cutter head, details of the fluid supply system being omitted for the sake of clarity.

FIG. 1 of the drawing shows a rotary cutter head 1 of a well known shearer type coal winning mining machine 2 (only a small portion of the cutting section body of which is shown) which in use repeatedly traverses to and fro along a longwall face with the rotary cutter head winning coal from the working face (a portion of which is indicated by broken line 3). The coal is cut by a plurality of cutting tools (not shown) mounted around the periphery of the cutter head, the cutting tools being mounted in holders (not shown) carried on the radially outer extremities of a plurality of cut mineral loading vanes 4 extending helically around and axially along a barrel support component 5 fixedly mounted with respect to a hub assembly 6 drivably mounted on a rotary drive shaft 7 extending from the cutting section of the mining machine. The cutting section may be constituted by a portion of the machine body. Alternatively, the cutting section may be constituted by a ranging arm pivotally mounted on the machine body.

The barrel support component 5 also is provided with a generally frusto conical annular back plate 16 forming the working face side of the cutter head 1 and carrying a plurality of tool holders (not shown) for cutting tools (not shown) arranged to form a newly exposed mineral face (indicated by broken line 8).

The hub assembly 6 comprises a wedge lock bush arrangement 17, 18 for drivably connecting the cutter head to the drive shaft 7. The inner bush element 17 is retained on the shaft by an end retaining plate 19 secured to the shaft and having a lip overlapping the working face side of the inner bush element.

The relatively outer bush element 18 has a conical wedge surface which co-operates with the conical wedge surface presented by the inner bush element. Thus, the outer bush element is drivably connected to the drive shaft via the inner bush element.

The barrel support component 5 is fixedly mounted on the outer bush element 18 of the hub assembly 6 by means of welding.

As seen in FIGS. 1 and 2 the outer bush element 18 defines an air flow duct arrangement comprising a plurality of air flow ducts 22 extending axially along the hub assembly. FIG. 2 shows the ducts 22 to extend substantially all around the hub assembly, the circumferential extent of the ducts far exceeding that of the radially extending partitions 23 provided between adjacent ducts.

The cutter head 1 is provided with a fluid supply system comprising an adaptor unit 30 fixedly secured to the cutting section body 2 and defining inlet means 31 for a relatively high pressure water feed and further inlet means 32 for a relatively low pressure water feed.

The relatively high pressure feed is fed from the inlet means 31 along an elongate passage 33 extending axially along a rod 34 mounted axially within a bore 35 provided in the hollow drive shaft 7. The feed from the passage 33 is fed to a distributor 36 fixedly mounted on the face side end of the rod 34. The distributor 36 is provided with radially extending passage means 37 leading to an annular chamber 38 having a plurality of outlet nozzles 39 (only one of which is shown in FIG. 1). The nozzles 39 are arranged to direct air flow inducing sprays towards the aforementioned air flow ducts 22 such that, in use, air flow is induced to flow from the working face side of cutter head via the ducts 22 towards the machine side of the cutter head. Alternatively, the chamber 38 may be replaced by radially drilled passages.

Although the nozzle 39 is shown mounted on the side of the distributor remote from the working face, in other embodiments the nozzles are mounted on the working face side of the distributor and therefore are more easily accessible for servicing or replacement. In the latter mentioned embodiment the nozzles are sealably passed through cross bores intersecting the annular chamber 38 such that they direct sprays towards the air flow ducts 22.

FIG. 1 also shows a nozzle 40 mounted on the radially outer margin of the distributor and arranged to direct a scouring spray around the radially inner portions of the rotating barrel support component 5 thereby tending to prevent or reduce build up of cut material which otherwise would tend to block the air flow inlet. In other embodiments a mechanical scraper element is provided instead or in addition to the scouring spray nozzle 40. The nozzle 40 is hydraulically connected to the annular chamber 38.

As indicated in FIG. 1 the adaptor unit 30, passage means 33, 34 and distributor 36 are constituted by a non-rotary component anchored to the body 2. Thus, no high pressure, rotary seal is required in the fluid supply system according to the present invention. Moreover, in use, the relative movement between the rotating hub and barrel assemblies 5 and 6 and the non rotating distributor 36 is effectively used to prevent building up of cut material which otherwise might tend to block the inlet for air flow. The scouring spray and/or mechanical scraper tending to assist the cleaning.

The relatively low pressure feed is fed from the inlet passage means 32 and via passage means 138 part way along the rod 34 to an annular chamber 41 formed between the outer cylindrical surface of the rod 34 and the inner wall of the bore 35 extending along the hollow drive shaft, the ends of the annular of the annular chamber 41 being closed by bearing members 139,42 provided with a plurality of seals 43. The bearing member 42 provided on the working face end of the rod 34 is fixedly mounted to the aforementioned retaining plate 19 which together with a co-operating annular plate 44 constitute further distributor means for the relatively low pressure feed which is fed from the annular chamber 41 via passages 45 in the bearing member 42 to radially extending connected passages 46, 47 in the plates 19 and 44, respectively. A connecting overlap arrangement 48 with seals 49 is provided to accommodate manufacturing tolerances in the wedge lock arrangement.

The relatively low pressure feed is fed from the radially outer end of the passages 47 into passages (not shown) formed in the aforementioned partitions 23 in the outer wedge element 18 and leading to a further annular chamber 50 defined between the recessed radially outer surface of the element 18 and the barrel support component 5. Further radially extending fluid channels (not shown) are formed in the loading vanes 4 to convey fluid from the chamber 50 to the further nozzle means (not shown) provided adjacent to cutting tools or cutting tool holders.

The plates 19 and 44 are retained by the aforementioned bolts (not shown) engaged in the end face of the drive shaft and by further bolts engaged in holes 51 and 52 (see FIG. 2).

In use, as the mining machine traverses along the working face with the rotating cutter head winning mineral relatively high pressure water is fed to the outlet nozzle means 39, 40 via the non rotating inlet means 31, passage means 33 and the distributor means 36, 37, 38. The air flow inducing sprays from the non-rotating outlet nozzle means 39 being associated with each of the air flow ducts 22 as the hub assembly rotates. Thus, as the cutter head rotates each nozzle 39 directs an air flow inducing spray along each of the air flow ducts in turn. Upon a spray from a nozzle 39 being directed at a partition 23 between two air flow ducts 22 the water is briefly deflected towards the air inlet existing between the rotating barrel support component 5 and the distributor 36 tending to scour the inlet and remove material which otherwise might present an obstruction to air flow.

The number of outlet nozzles 39 exceeds the number of ducts 22 such that at any one time each duct has at least one air flow inducing spray directed along the duct.

Relatively low pressure water is fed to the outlet nozzles provided adjacent to the cutting zone via the inlet passage means 32 and annular chamber 41, and via the rotating distributing means 19, 44 to the further annular chamber 50 from where it is fed to the nozzles via the passage means provided in the loading vanes 4 or back plate 16.

From the above description it will be appreciated that the present invention provides an improved fluid supply system to a rotary cutter head, the system providing an efficient safe and reliable ventilating air flow to be obtained over long operational periods.

One further advantage is achieved by having the radial dimension between the barrel component 5 and the distributor 36 (ie the air flow inlet less than the radial dimension of the air flow ducts 22). Thus, the first mentioned dimension tends to restrict the size of material entering the air flow system to below that which can pass through the system.

We claim:

1. A fluid supply system for a rotary cutter head for a mining machine having a non rotary body and a rotary drive shaft upon which the cutter head is mountable, the supply system comprising an adaptor unit mountable on the machine body and defining fluid inlet means, passage means for feeding fluid from the inlet means along the drive shaft, and distributor means for feeding fluid from the passage means to outlet nozzle means adapted to direct air flow inducing sprays within the rotary cutter head, the adaptor unit, passage means and distributor means constituting a non rotary component, the fluid supply system also comprising further distributor means for feeding fluid to further outlet nozzle means mountable on the cutter head, the further distributor means being adapted to rotate with the cutter head.

2. A system as claimed in claim 1, in which the outlet nozzle means are adapted to direct air flow inducing sprays towards air flow ducts within the rotary cutter head.

3. A system as claimed in claim 2, in which the adaptor unit defines further fluid inlet means for a second fluid feed which, in use, is fed via further passage means to further distributor means for feeding fluid to further outlet nozzle means mountable on the cutter head.

4. A rotary cutter head for mounting on a rotary drive shaft of a cutting section of a mining machine, the cutter head having a hub assembly drivably mountable on the drive shaft, a support component mounted around the hub assembly, a plurality of cutting tool holders supported by the component, and a fluid supply system comprising an adaptor unit mountable on the mining machine and defining fluid inlet means, passage means for feeding fluid from the inlet means along the drive shaft, and distributor means for feeding fluid from the passage means to outlet nozzle means adapted to direct air flow inducing sprays withing the rotary cutter head, the adaptor unit, passage means and distributor means constituting a non rotary component, the fluid supply system also comprising further distributor means for feeding fluid to further nozzle means mounted on the cutter head, the further distributor means being adapted to rotate with the cutter head.

5. A cutter head as claimed in claim 4, in which an air flow duct arrangement is provided around the hub assembly, the outlet nozzle means being adapted to direct air flow inducing sprays associated with the air flow duct arrangement.

6. A cutter head as claimed in claim 5, in which the adaptor unit defines further fluid inlet means for a second fluid feed which, in use, is fed via further passage means to further distributor means for feeding fluid to further outlet nozzle means mountable on the cutter head.

* * * * *